US010760744B2

(12) United States Patent
Wu et al.

(10) Patent No.: US 10,760,744 B2
(45) **Date of Patent: *Sep. 1, 2020**

(54) LED FILAMENT LIGHT

(71) Applicant: XIAMEN ECO LIGHTING CO. LTD., Xiamen (CN)

(72) Inventors: Minghao Wu, Xiamen (CN); Yanzeng Gao, Xiamen (CN); Feng Wu, Xiamen (CN); Fuwen Li, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/288,100

(22) Filed: Feb. 28, 2019

(65) Prior Publication Data

US 2019/0195436 A1 Jun. 27, 2019

Related U.S. Application Data

(63) Continuation of application No. 15/599,421, filed on May 18, 2017, now Pat. No. 10,253,931.

(30) Foreign Application Priority Data

Oct. 19, 2016 (CN) ..... 2016 1 0909469
Mar. 9, 2017 (CN) ..... 2017 1 0137320

(51) Int. Cl.
*F21V 21/00* (2006.01)
*F21K 9/237* (2016.01)
(Continued)

(52) U.S. Cl.
CPC ..... *F21K 9/237* (2016.08); *F21K 9/232* (2016.08); *F21K 9/238* (2016.08); *F21V 3/02* (2013.01);
(Continued)

(58) Field of Classification Search
CPC ..... F21K 9/235; F21K 9/238; F21K 9/232; F21V 29/60; F21V 3/02; F21V 23/06;
(Continued)

(56) References Cited

U.S. PATENT DOCUMENTS 10,253,931 B2 * 4/2019 Wu ..... F21V 29/60
2013/0058080 A1 * 3/2013 Ge ..... F21V 3/00 362/231
(Continued)

*Primary Examiner* — Laura K Tso
(74) *Attorney, Agent, or Firm* — Chun-Ming Shih; LanWay IPR Services

(57) ABSTRACT

An LED filament light including a bulb, a support bar, at least two electrode wires and at least two LED filament strips. Each LED filament strip including a base, an LED chip is set on the base and an electrode is fixed at both ends of the base. One end of the electrode is electrically connected with an LED chip on the base, the other end of the electrode is electrically connected with an electrode of another LED filament or electrically connected to one end of the electrode wires so that the support bar is fixed to the bulb, and the other end is connected with at least one. As the support bar is set to replace the existing LED filament light core and metal wire, and creatively the LED filament electrodes directly is connected to each other.

7 Claims, 10 Drawing Sheets

(51) Int. Cl.

| | |
|---|---|
| ***F21V 29/60*** | (2015.01) |
| ***F21K 9/238*** | (2016.01) |
| ***F21K 9/232*** | (2016.01) |
| ***F21V 3/02*** | (2006.01) |
| ***F21V 17/10*** | (2006.01) |
| ***F21V 19/00*** | (2006.01) |
| ***F21V 23/06*** | (2006.01) |
| *F21Y 107/00* | (2016.01) |
| *F21Y 115/10* | (2016.01) |

(52) U.S. Cl.
CPC ..... *F21V 17/105* (2013.01); *F21V 19/005* (2013.01); *F21V 23/06* (2013.01); *F21V 29/60* (2015.01); *F21Y 2107/00* (2016.08); *F21Y 2115/10* (2016.08)

(58) Field of Classification Search
CPC .. F21V 17/105; F21V 19/005; F21Y 2107/00; F21Y 2115/10
USPC ..... 362/235
See application file for complete search history.

(56) References Cited

U.S. PATENT DOCUMENTS

| | | | | |
|---|---|---|---|---|
| 2017/0038050 | A1* | 2/2017 | Rao | F21V 29/503 |
| 2017/0122499 | A1* | 5/2017 | Lin | F21V 29/50 |
| 2017/0167667 | A1* | 6/2017 | Ma | F21V 3/00 |
| 2017/0336038 | A1* | 11/2017 | Kim | H01L 27/156 |
| 2018/0045380 | A1* | 2/2018 | Li | H01L 25/00 |
| 2018/0245744 | A1* | 8/2018 | Li | F21K 9/232 |

* cited by examiner

LED FILAMENT LIGHT

RELATED APPLICATION

This application is a continued application of U.S. patent application Ser. No. 15/599,421.

TECHNICAL FIELD

The present invention is related to a lighting field and more particularly related to an LED (Light Emitting Diode) filament light.

BACKGROUND

At present, with LED (Light Emitting Diode) chip manufacturing and packaging technology maturity, cost of LED (Light Emitting Diode) components greatly reduce. LED (Light Emitting Diode) has been more and more widely used. In the field of LED (Light Emitting Diode) lighting field, advantages of saving and long life of LED energy have been fully reflected. More and more users using such as incandescent lamps and other traditional lamps change to LED (Light Emitting Diode) lights, especially the LED (Light Emitting Diode) filament light with the same appearance as traditional incandescent lamp loved by the users. The LED (Light Emitting Diode) filament light appears more and more on market.

However, core of the LED (Light Emitting Diode) filament light appearing on current market is often made of whole set of glass to support a number of LED (Light Emitting Diode) filament strips. In order to form a series or parallel connection between the different LED (Light Emitting Diode) filament strips, it is also necessary to fix one or two of metal wires at top of a stem for electrical connection and be fixed between the LED (Light Emitting Diode) filament strips. However, since the core is a material of glass, it is easy to be broken during production and transportation process, and it is necessary to additionally pour the one or two metal wires in middle of top part so that not only a yield of the stem but also the LED (Light Emitting Diode) filament are low, and increase process steps to reduce production efficiency of product.

SUMMARY OF INVENTION

In view of this, it is necessary to provide a structure of high reliability and simple production process of an LED (Light Emitting Diode) filament light.

The LED (Light Emitting Diode) filament light includes a bulb, a support bar, at least two electrode wires and at least two LED (Light Emitting Diode) filament strips. Each LED filament strip includes a base, an LED (Light Emitting Diode) chip is set on the base and electrode is fixed at both ends of the base. One end of the electrode is electrically connected with the LED chip on the base, the other end of the electrode is electrically connected with the electrode of another LED (Light Emitting Diode) filament or electrically connected to one end of the electrode wires so that on end of the support bar is fixed to the bulb, and the other end of the support bar is connected to at least one LED (Light Emitting Diode) filament strip to support the LED (Light Emitting Diode) filament strip.

Further, the bulb includes a bulb shell and a stem. The bulb shell and the stem form a closed space. The electrode wires extend from the outside into a confined space, and the LED (Light Emitting Diode) filament strip is accommodated in the confined space.

Further, the confined space is filled with heat dissipation gas.

Further, the support bar is made of rigid material, and the other end of the support bar is fixedly connected to the LED (Light Emitting Diode) filament strip.

Further, the other end of the support bar is welded to the electrode of the two LED (Light Emitting Diode) filament strip.

Further, the LED (Light Emitting Diode) filament strip is a rigid structure, and the LED (Light Emitting Diode) filament strips are connected to each other to form a rigid annular structure.

Further, the other end of the electrode is fixed by welding to the electrode of the other LED (Light Emitting Diode) filament strip to achieve electrical connection.

Further including four LED (Light Emitting Diode) filament strips, two support bars and four electrode wires, the LED (Light Emitting Diode) filament strips being connected in series with two electrode wires, respectively, and the other end of each support bar is connected with two LED (Light Emitting Diode) filament strips. The electrode is welded at the electrical connection.

Further including two LED (Light Emitting Diode) filament strips, two support bars and two electrode wires, one end of the LED (Light Emitting Diode) filament strip is electrically connected to one of the electrode wires, and the other end of the LED (Light Emitting Diode) filament strip is respectively connected with the two supporting bars and the other end of the two supporting rods is electrically connected to each other to form a connecting structure having two supporting bars and two LED (Light Emitting Diode) filament strips connected in series.

Further, the support bar is in the form of a straight strip, and the electrode at the other end of each LED (Light Emitting Diode) filament are electrically connected together and welded and fixed to the other end of the support bar.

Further, each support bar includes a parallel section and a folded section, the parallel sections of the two support bars are fixed parallel to each other on the stem, both of the folded sections are oriented in a direction away from the other support bar welded to the electrodes of the two LED (Light Emitting Diode) filament wires after bending the parallel section.

Further, including the four LED (Light Emitting Diode) filament strips, the electrodes at one end of the four LED (Light Emitting Diode) filament strips are welded to the other end of the support bar.

Further, the support bar is made of a metal wire having certain structural strength.

Further, the electrode wire is made of a wire which is bendable and has certain structural strength.

Further including a drive assembly, an insulating sleeve and a light head, the drive assembly is housed in the insulating sleeve, the insulating sleeve is housed in the light head, the drive assembly is respectively connected to the other end of the electrode wire and the lamp and the light head is fixed to one end of the bulb.

Compared with today technology, the LED (Light Emitting Diode) filament light is firmly fixed in the LED (Light Emitting Diode) filament light by providing the support bar on the stem, connecting and supporting the LED (Light Emitting Diode) filament through the support bar. As the support bar is set to replace the existing LED (Light Emitting Diode) filament light core and metal wire, and creatively LED (Light Emitting Diode) filament electrodes are directly connected to each other so that the LED (Light Emitting Diode) owns the advantages of filament light with high reliability and simple production.

According to another embodiment of the present invention, there provides a light apparatus.

A lighting apparatus includes:

a translucent shell;

a base which is connected to the translucent shell to form placing space and has a connecting line from the exterior of the illuminating device as viewed from the outside of the illuminating device, lining to the top of the translucent shell is first height;

a support base is set on the base, the support base has a platform at an uppermost position and a support seat is set in an accommodation space, and the height difference between the platform top end and the connection boundary line is second height;

a light bar module is connected in series by at least two light strips, a support point is between the at least two series light strips, and the light bar module has two electrical connection points;

at least two metal support strips extend outwardly from the platform of the support base, and is respectively connected to the one support point, a metal support strip extends vertically from the platform to third highest height, the third height being greater than the second height; and at least two metal conductive strips extend from the support base respectively to an electrical connection point of the light strip module, wherein the metal support strip, the light strip and the metal conductive strip forms two edge components of a solid triangular frame structure.

Further, all of the light strip modules are held above the platform.

Further, the material of the support seat is glass.

Further, the support base has a top structure and a base, the top structure is joined together with the base by fusing, and the metal support strip and the metal conductive strip are extended out from the top structure.

Further, the top structure is an inverted U-shape, and a bottom of the base is substantially circular.

Further, the second height exceeds 30% of the first height.

Further, the platform height of the support base is lower than the bottom position of the lamp bar of the light strip module.

Further, the metal support strip is made of a material of the same material as the metal conductive strip.

Further, the light strip of the light strip module includes at least two light emitting diode chips encapsulated with a light transmission material, and both sides of the light bars are packaged with a light emitting diode chip.

Further, the metal support strip has a groove along its length.

Further, the metallic support strip is plated with nickel.

Further, the metal support strip is made of pure metal or metal alloy.

Further, the top end of the metal support strip is set with a magnetic terminal containing a magnet having a conductive substance on the surface, and the light bars are electrically connected in series or parallel or in both series and parallel through the magnetic terminals.

According to another embodiment of the present invention, there provides an illumination device.

A lighting apparatus, wherein the lighting apparatus includes:

at least two strip-shaped light strips, each strip-shaped light strip has at least two LED (Light Emitting Diode) light-emitting chips;

a support base is connected to one end of the at least two strip-shaped light strips so that an LED (Light Emitting Diode) light emitting chip on the at least two strip-shaped light strips emits light toward a predetermined angle; and wherein the support bar is connected to one end of the at least two strip-shaped light strips by a magnetic force.

Further including a magnetic terminal is set at the top of the support, the magnetic force being from the magnetic terminal.

Further, the material of the surface of the magnetic terminal is conductive, and strip-shaped light strips are electrically connected in series or parallel or in both series and parallel through the magnetic terminals.

Further, the support and the at least two strip-shaped light strips are no electrical connection in the middle.

Further, the top of the support forms an electrical connection structure for electrically connecting the two strip lights.

Further, the support provides power to the strip of light through a position connected to the strip of light.

DETAILED DESCRIPTION

The LED (Light Emitting Diode) filament light of the first embodiment of the present invention is described further below with the attached drawings and the specific embodiments.

Figure 1:
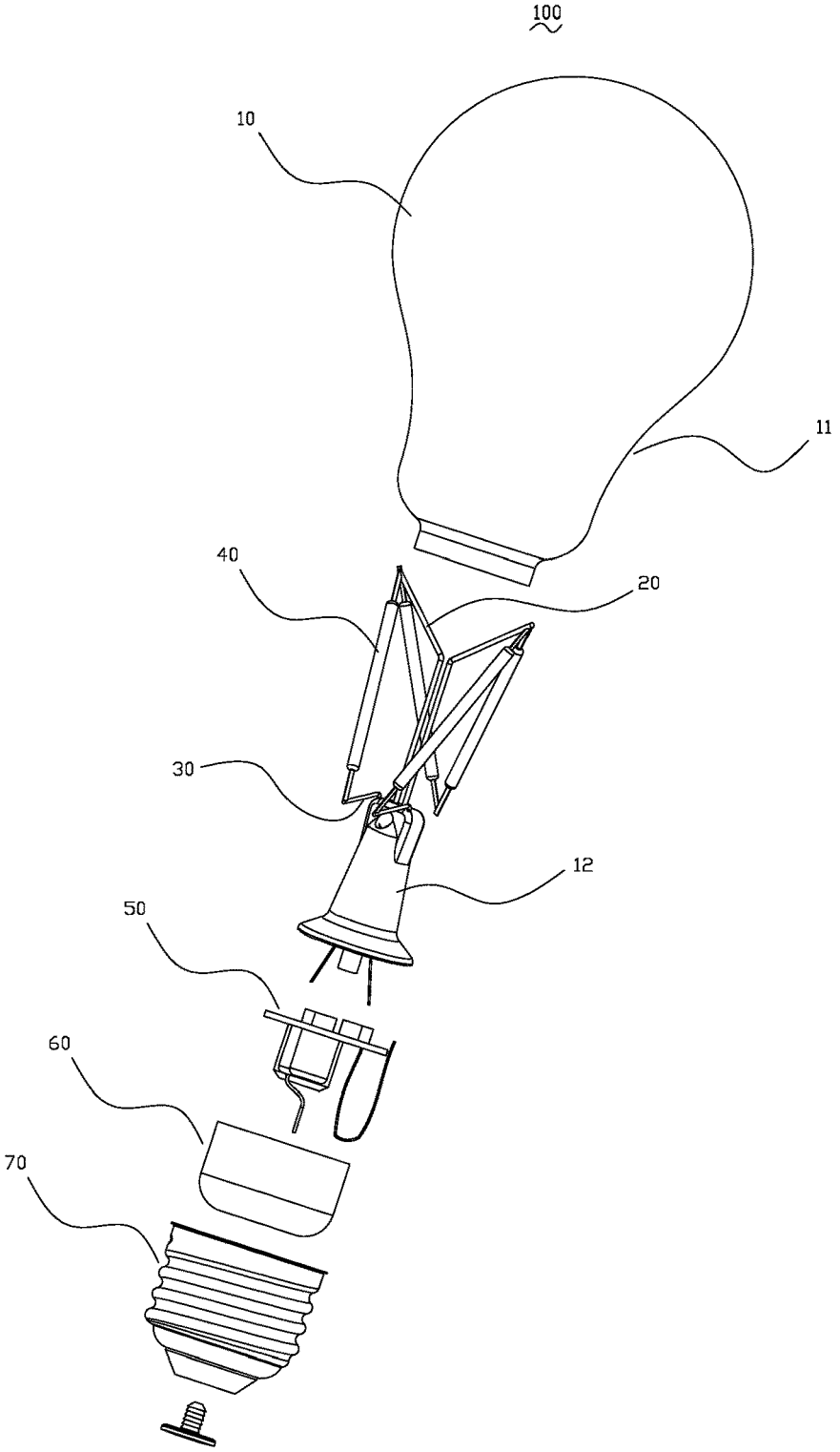
FIG. 1 is the exploded perspective view of the LED (Light Emitting Diode) filament light according to a first embodiment of the present invention.
Figure 2:
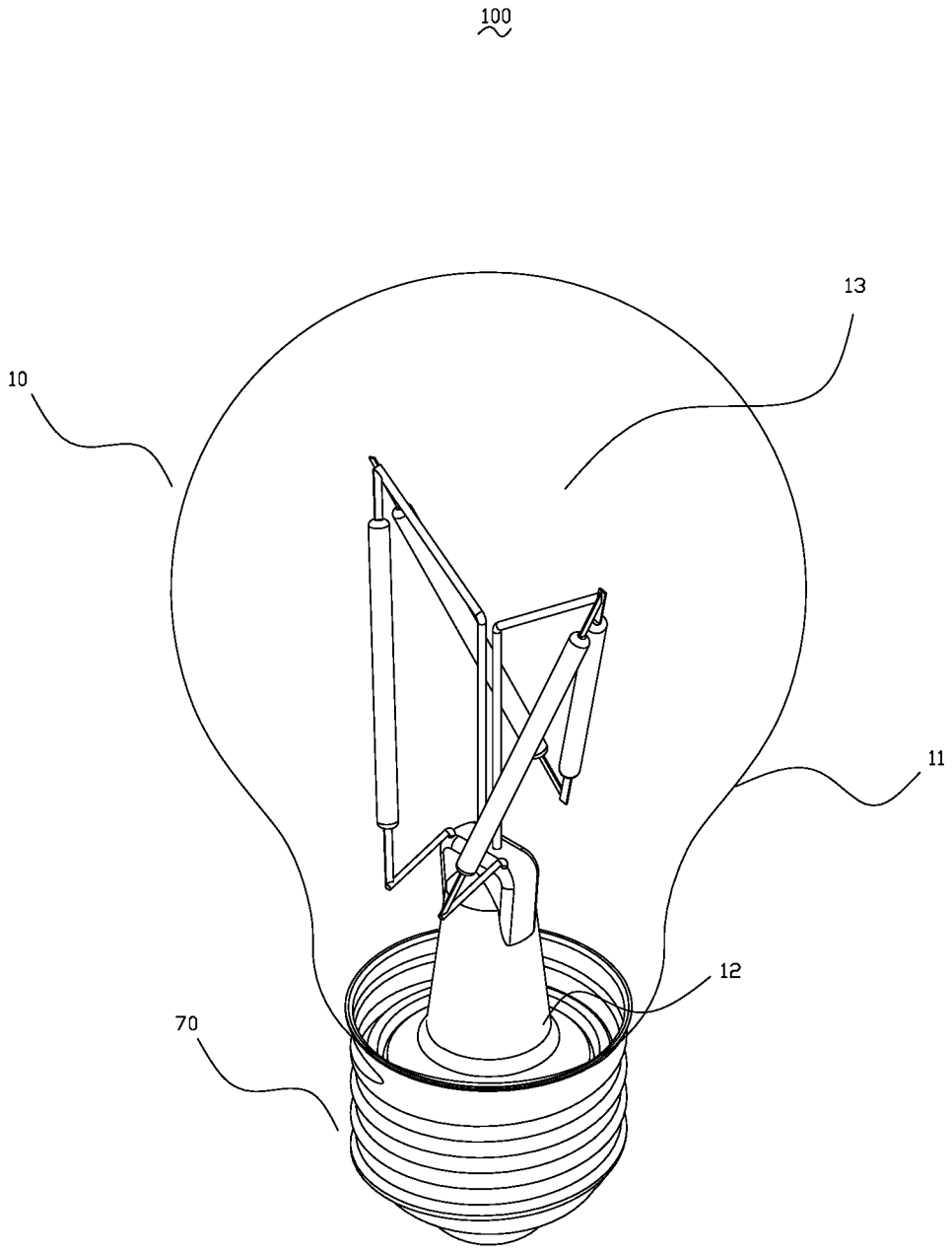
FIG. 2 is the schematic view that the assembly of the LED (Light Emitting Diode) filament light illustrated by FIG. 1.
Figure 3:
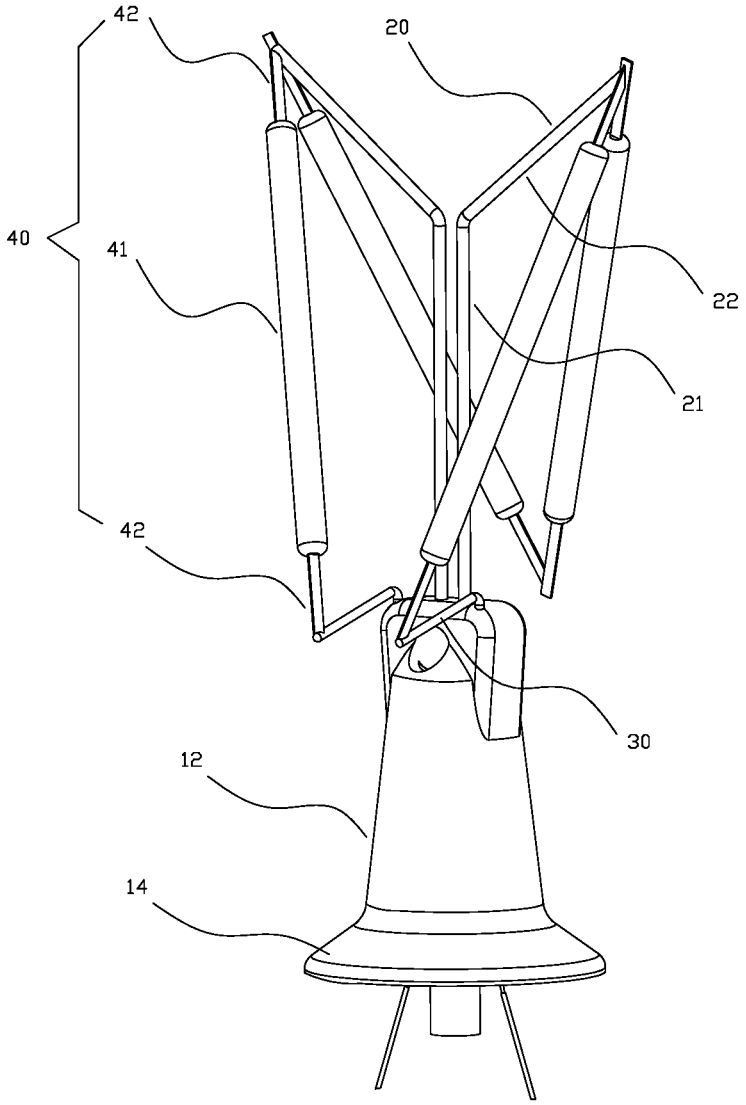
FIG. 3 is the perspective view of the LED (Light Emitting Diode) filament light excluding the lamp head and bulb shell illustrated by FIG. 1.

Please refer to FIG. 1 to FIG. 3, wherein the LED (Light Emitting Diode) filament light (100) includes a light bulb (10), a supporting bar (20), two electrode wires (30), four LED (Light Emitting Diode) filament strips (40), a drive assembly (50), an insulating sleeve (50), and a light head (70).

Each LED (Light Emitting Diode) filament strip (40) includes a base (41), and the LED (Light Emitting Diode)

chip is set on the base (41) and the electrode (42) are fixed on two ends of the base (41). One end of the electrode (42) is separately and electrically connected to the LED (Light Emitting Diode) chips on the base (41). The other end of the electrode (42) and the electrode (42) of another LED (Light Emitting Diode) filament strip (40) are connected electrically or the other end of the electrode (42) is connected to the electrode wire (30) electrically to make the LED (Light Emitting Diode) filament strip (40) form an electrical connection structure with at least two electrical wires (30). The electrical wire (30) is able to be bent and formed by the wire with structural strength. The electrical wire (30) may support the LED (Light Emitting Diode) filament strip (40) being fixed on the electrical wire (30) to make one end of the LED (Light Emitting Diode) filament strip (40) overcome gravity or other influence of external force to be supported in the LED (Light Emitting Diode) filament light (100). Meanwhile, the electrical wire (30) may be the original shape and unchanged under the pressure of the LED (Light Emitting Diode) filament strip (40). One end of the supporting bar (20) is fixed on the light bulb (10). The other end of the supporting bar is connected to at least two LED (Light Emitting Diode) filament strips (40) to support the LED (Light Emitting Diode) filament strip (40). These LED (Light Emitting Diode) filament strips (40) are connected to each other to form a rigid annular structure. In this way, on the other hand, the LED (Light Emitting Diode) filament strips (40) are welded and fixed to each other, and may be held in a spatial position of the LED (Light Emitting Diode) filament light to achieve uniform illumination at a large angle. The drive assembly (50) is housed in an insulating sleeve (60) which is housed in the lamp head (70), and the drive assembly (50) is electrically connected to the other end of the electrode wire (30) and the lamp head (70), respectively, the lamp head (70) is fixed to one end of the bulb.

Please refer to FIG. 2 to FIG. 3, the light bulb (10) includes a bulb shell (11) and a stem (12). A bottom of the stem (12) has a flared connection portion (14) shaped in the shape of the bottom opening of the bulb shell (11) and welded together at a high temperature with the bottom end of the bulb shell (11) so that the bulb shell (11) forms a confined space (13) with the stem (12). The electrode wire (30) extends from the outside into the confined space (13). The electrode wire (30) is preliminarily embedded and fixed to the stem (12), one end of which is protruded from the top of the stem (12) and the other end of the electrode wire (30) is protruded from the bottom end of the stem (12). These LED (Light Emitting Diode) filament strips (40) are accommodated in the confined space (13). In order to enhance the rate of heat dissipation generated during operation of the LED (Light Emitting Diode) filament strips (40), the confined space (13) may be filled with heat dissipation gas such as gas filled with helium, neon, argon, nitrogen, or a combination in the middle of the bulb shell (11), and the heat generated by the LED (Light Emitting Diode) filament strips (40) is transmitted to the bulb shell (11) and emitted from the bulb shell (11) to the outside.

Please refer to FIG. 3, the support bar (20) is made of a rigid material. Preferably, the support bar (20) is made of a metal wire having a certain structural strength, for example made of a metal or alloy wire having rigidity. The support bar (20) are structurally strong enough to support these LED (Light Emitting Diode) filament strips (40) being fixed to the support bar (20) without deformation of the support bar (20) such that a position of the LED (Light Emitting Diode) filament strips (40) and the support bar (20) related to the stem (12) may not be changed. One end of the support bar (20) is fixed to the stem (12) on the bulb, and the other end of the support bar (20) is fixedly connected to the LED (Light Emitting Diode) filament strips (40). The support bar (20) is fixed to one end of the stem (12) and is merely fixed not electrically connected to other components. Each of the support bars (20) includes a parallel section (21) and a bending section (22) in which the parallel sections (21) of the support bars (20) are fixed to the stem (12) in parallel with each other. Both facing away from the other support bar (20) are welded to the electrode (42) of the two LED (Light Emitting Diode) filament strips (40) after being bent with respect to the parallel section (21). This allows the LED (Light Emitting Diode) filament yarns to form a relatively dispersed arrangement between the LED (Light Emitting Diode) filament strips (40), and not only enables the LED (Light Emitting Diode) filament yarns to reach the characteristics of the conventional incandescent ring reticular luminescence, but also facilitate the uniform illumination of the large angle.

Please refer to FIG. 2 to FIG. 3, where each LED (Light Emitting Diode) filament strip (40) has a base (41). The electrode (42) is set on two ends of the base (41) and is easy to be electrically connected to other section components. The other end of the support bar (20) is electrically connected to the electrode (42) of the two LED (Light Emitting Diode) filament strips (40) so that the LED (Light Emitting Diode) filament strips (40) are firmly fixed to the support bar (20). The LED (Light Emitting Diode) filament strip (40) is a rigid structure and the other end of the electrode (42) is fixed by welding with the electrode (42) of the other LED (Light Emitting Diode) filament strips (40) when one LED (Light Emitting Diode) filament strips (40) is in series with another LED (Light Emitting Diode) filament strips (40) to achieve electrical connection. Since these LED (Light Emitting Diode) filament strips (40) are rigid structures, the electrode (42) of the two LED (Light Emitting Diode) filament strips (40) may be held by the welding connection and remain in the form of the welded connection without being affected by the gravity of the LED (Light Emitting Diode) filament strips (40) and changing in bending or a relative position.

Figure 4:
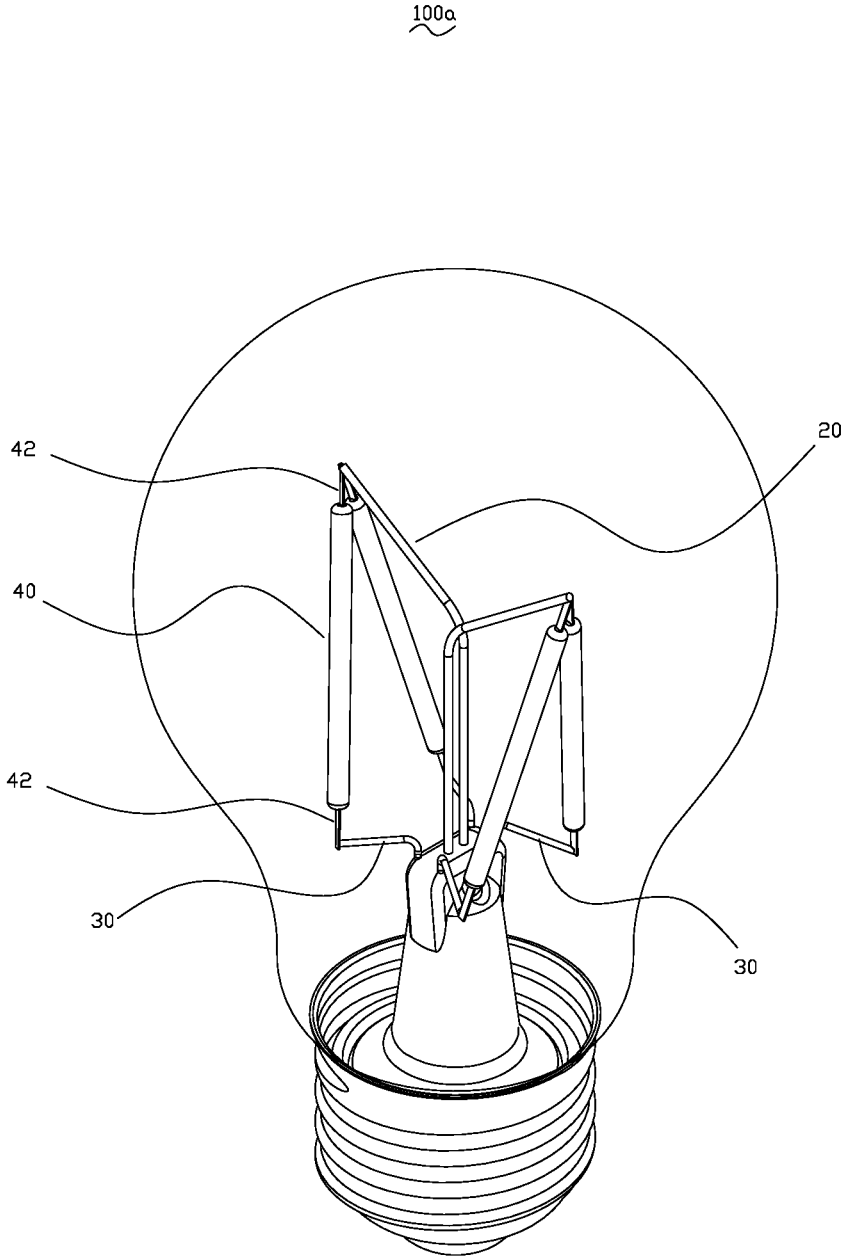
FIG. 4 is a perspective view of an LED (Light Emitting Diode) filament light according to the second embodiment of the present invention.

The present invention also provides a second embodiment. The embodiment provides another different connection structure of LED (Light Emitting Diode) filament light (100*a*). Please refer to FIG. 4, the LED (Light Emitting Diode) filament light (100*a*) includes four LED (Light Emitting Diode) filament strips (40), two support bars (20) and four electrode wires (30). The LED (Light Emitting Diode) filament strips (40) are connected in series with the electrode wires (30), each of the support bars (20) is connected in series with each other and is welded to the electrode (42) of the two LED (Light Emitting Diode) filament strips (40) to form two light source groups, each consisting of two LED (Light Emitting Diode) filament strips (40) in series and each group is independently illuminated. The LED (Light Emitting Diode) filament light (100*a*) may achieve a single set of light emission under the intelligent control of the drive assembly (50). One of the two series of connected LED (Light Emitting Diode) filament strips (40) emits light or both sets of light source groups emit light. The remaining structures are the same as those of the first embodiment, and may not be described again.

Figure 5:
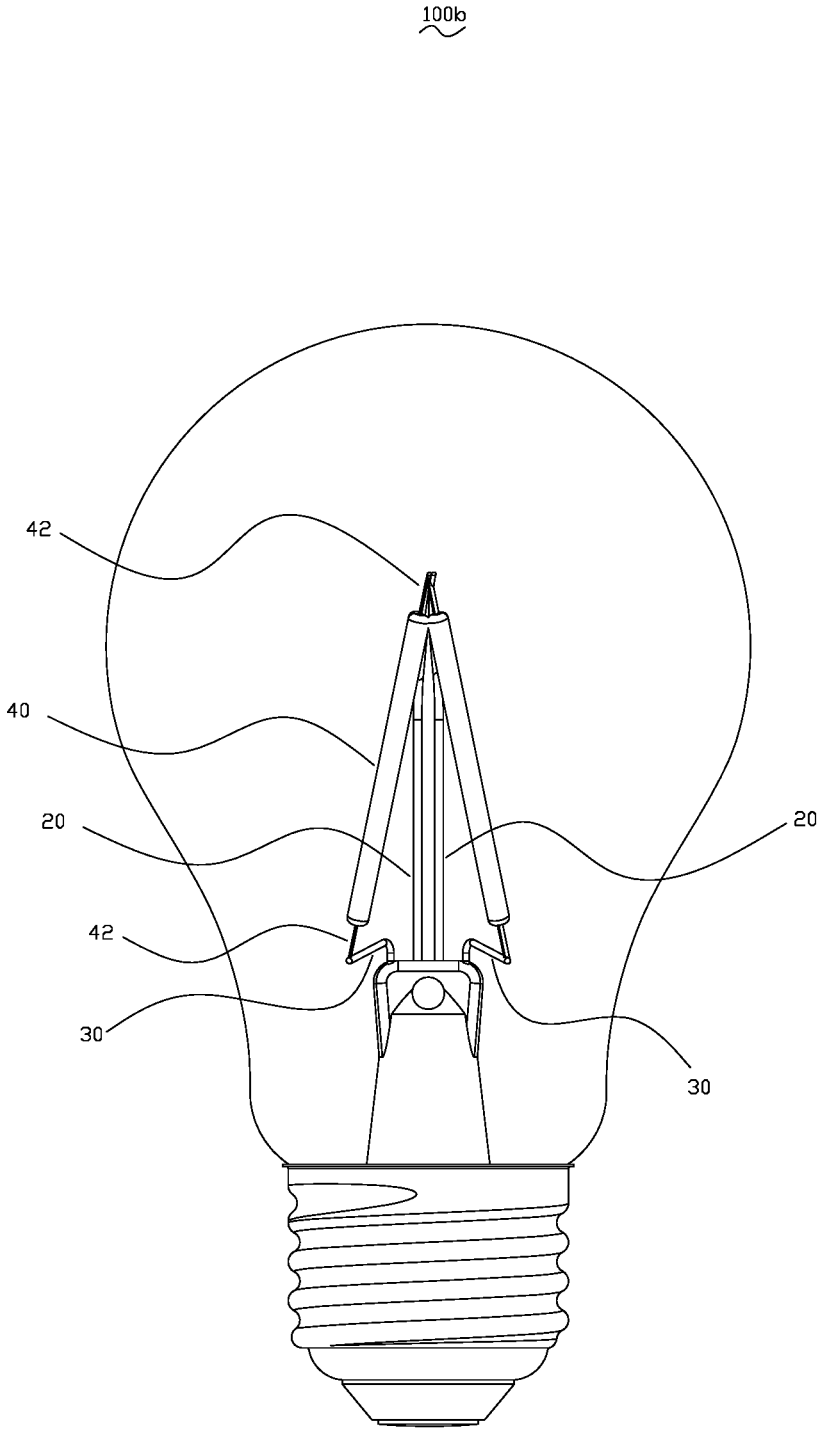
FIG. 5 is a front view of an LED (Light Emitting Diode) filament light according to the third embodiment of the present invention.

The present invention also provides a third embodiment. The embodiment provides another different connection structure of LED (Light Emitting Diode) filament light (100*b*). Please refer to FIG. 5, the LED (Light Emitting Diode) filament light (100*b*) includes two LED (Light Emitting Diode) filament strips (40), two support bars (20) and two electrode wires (30). The electrode (42) at one end of each LED (Light Emitting Diode) filament strips (40) is connected to one of the electrode wires (30), and the electrode (42) at the other end of each LED (Light Emitting Diode) filament strips (40) is electrically connected together and welded. The other end of the support bars (20) is electrically connected to the other end of the two support bars (20) to form a connection structure having two support bars (20) and two LED (Light Emitting Diode) filament strips (40) to be connected in series. The LED (Light Emitting Diode) filament light (100*b*) has a stronger shock resistance and may be applied to a use environment where a high seismic strength is required. The remaining structures are the same as those of the first embodiment, and may not be described again.

Figure 6:
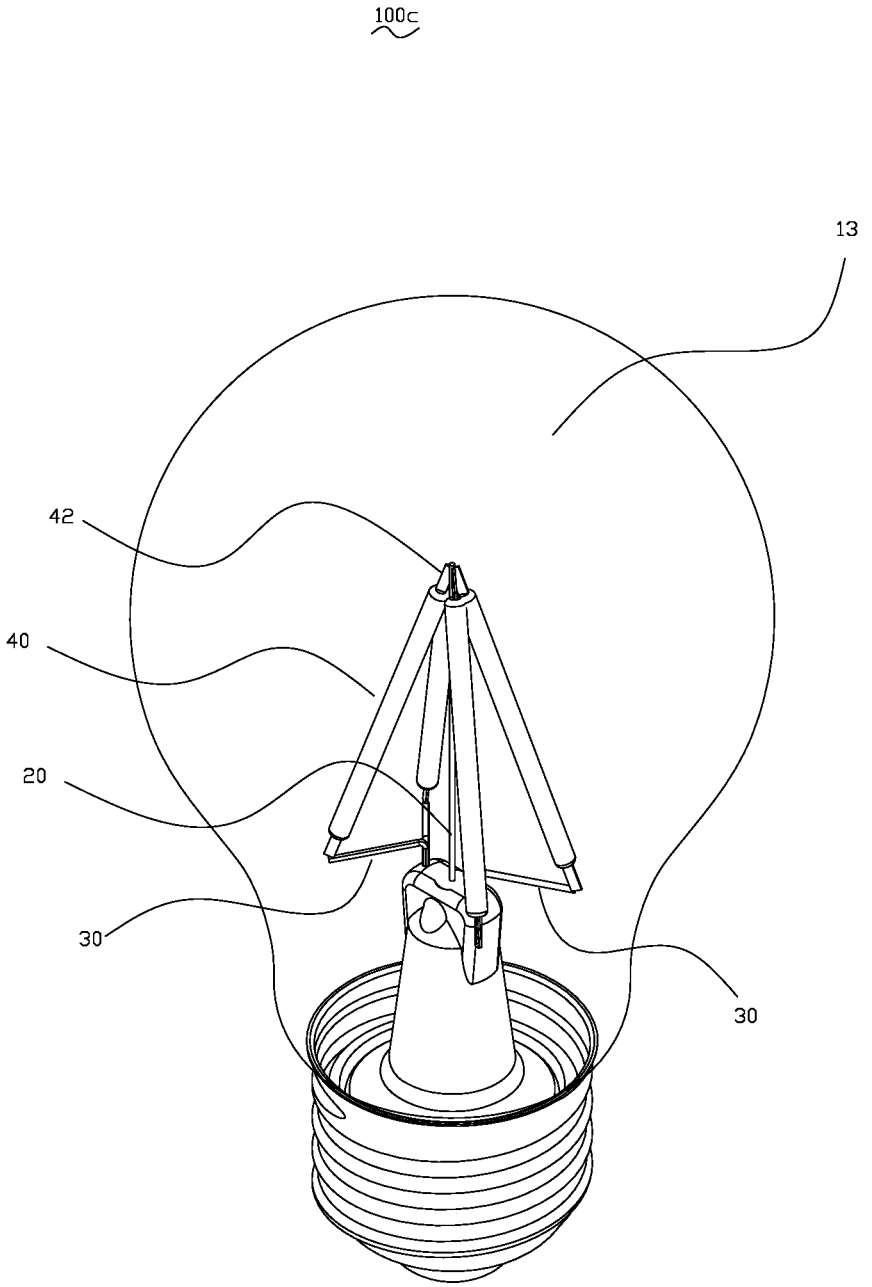
FIG. 6 is a perspective view of an LED (Light Emitting Diode) filament light according to the fourth embodiment of the present invention.

The present invention also provides a fourth embodiment. The embodiment provides another different connection structure of LED (Light Emitting Diode) filament light (100*b*). Please refer to FIG. 6, the LED (Light Emitting Diode) filament light (100*c*) includes a support bar (20), two bifurcated electrode wires (30), and four LED (Light Emitting Diode) filament strips (40). The support bar (20) is in the form of a straight strip, and the electrode (42) at one end of the four LED (Light Emitting Diode) filament strips (40) is welded to the other end of the support bar (20), and the upper portion of each electrode wires (30) is divided into two sub-power lines. The electrode (42) at the other end of the LED (Light Emitting Diode) filament strips (40) are electrically connected to the respective sub power lines, respectively, so that the four LED (Light Emitting Diode) filament strips (40) form two strings of two electrically connected structures. The electrode wires (30) are set in such a manner that the number of electrode wires (30) set in the stem (12) may be reduced, and the four electrode wires (30) may be provided with respect to the second embodiment of the present invention. The remaining structures are the same as those of the first embodiment, and may not be described again.

Figure 7:
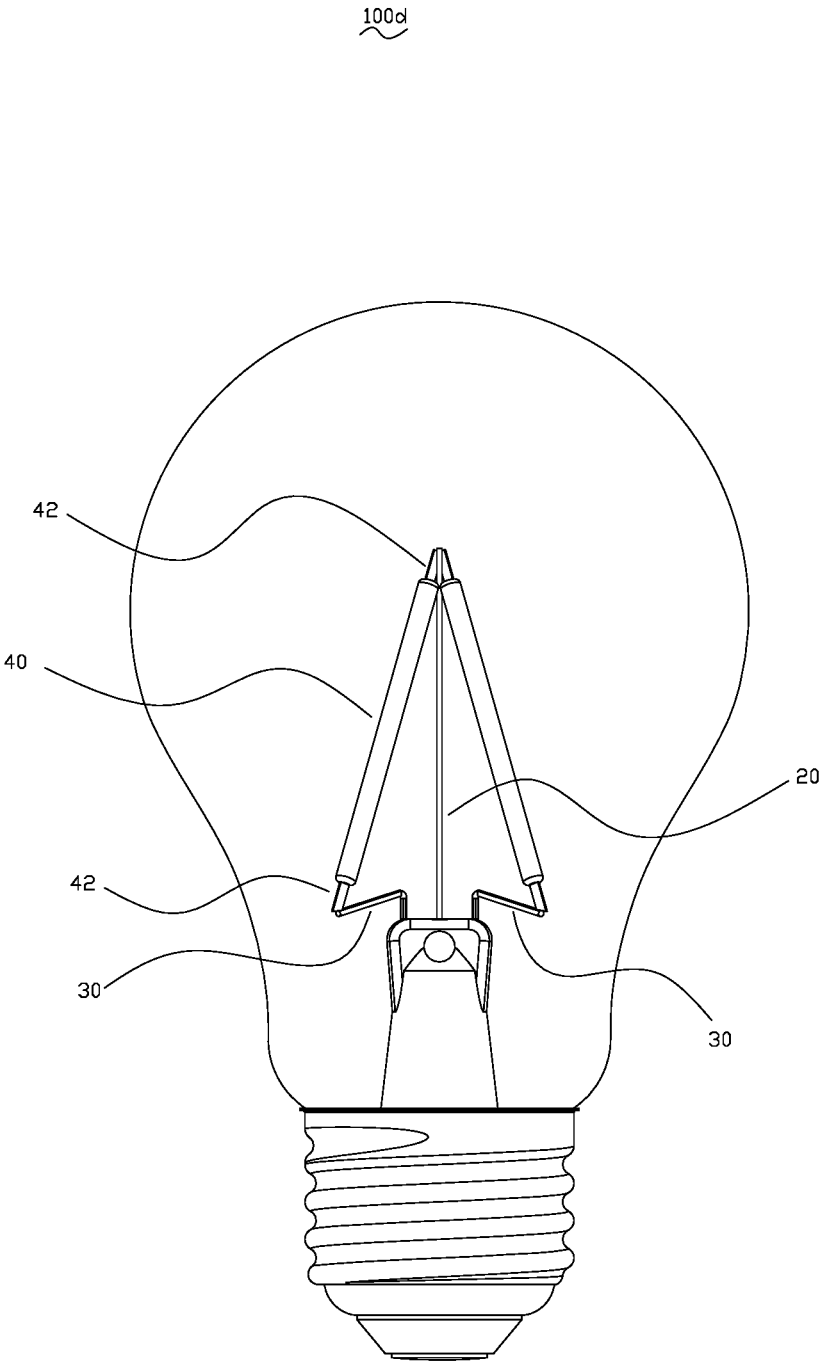
FIG. 7 is a front view of an LED (Light Emitting Diode) filament light according to the fifth embodiment of the present invention.

The present invention also provides a fifth embodiment. The embodiment provides another different connection structure of the LED (Light Emitting Diode) filament light (100*d*). Please refer to FIG. 7, the LED (Light Emitting Diode) filament light (100*d*) includes a support bar (20), two electrode wires (30) and two LED (Light Emitting Diode) filament strips (40). The electrode (42) at one end of the LED (Light Emitting Diode) filament strips (40) is connected to one end of the two electrode wires (30), and the other electrode (42) of the LED (Light Emitting Diode) filament strips (40) is connected to the other end of the support bar (20). One end of the connection, the formation of two LED (Light Emitting Diode) filament strips (40) series of electrical connection structure. The structure of the LED (Light Emitting Diode) filament light (100*d*) is relatively simple, and the number of the LED (Light Emitting Diode) filament strips (40) is small, and it is suitable for the design of the lower power. The remaining structures are the same as those of the first embodiment, and may not be described again.

In view of the above, the LED (Light Emitting Diode) filament light is set with a support bar (20) made of a rigid metal wire on the stem (12) to improve the toughness and strength of the support bar (20) as compared with the prior art using a glass material as a support bar The electrode (42) for supporting and connecting the LED (Light Emitting Diode) filament strips (40) and the LED (Light Emitting Diode) filament strips (40) may be directly welded and fixed to the other end of the support bar (20), not only the yield of the finished product of the stem (12) and the LED (Light Emitting Diode) filament light. The process steps of additionally providing one or two pieces of metal wires at the other end of the support bar (20) are omitted, so that the production efficiency of the product is improved greatly by the production of the stem (12) and the LED (Light Emitting Diode) filament light.

Figure 8:
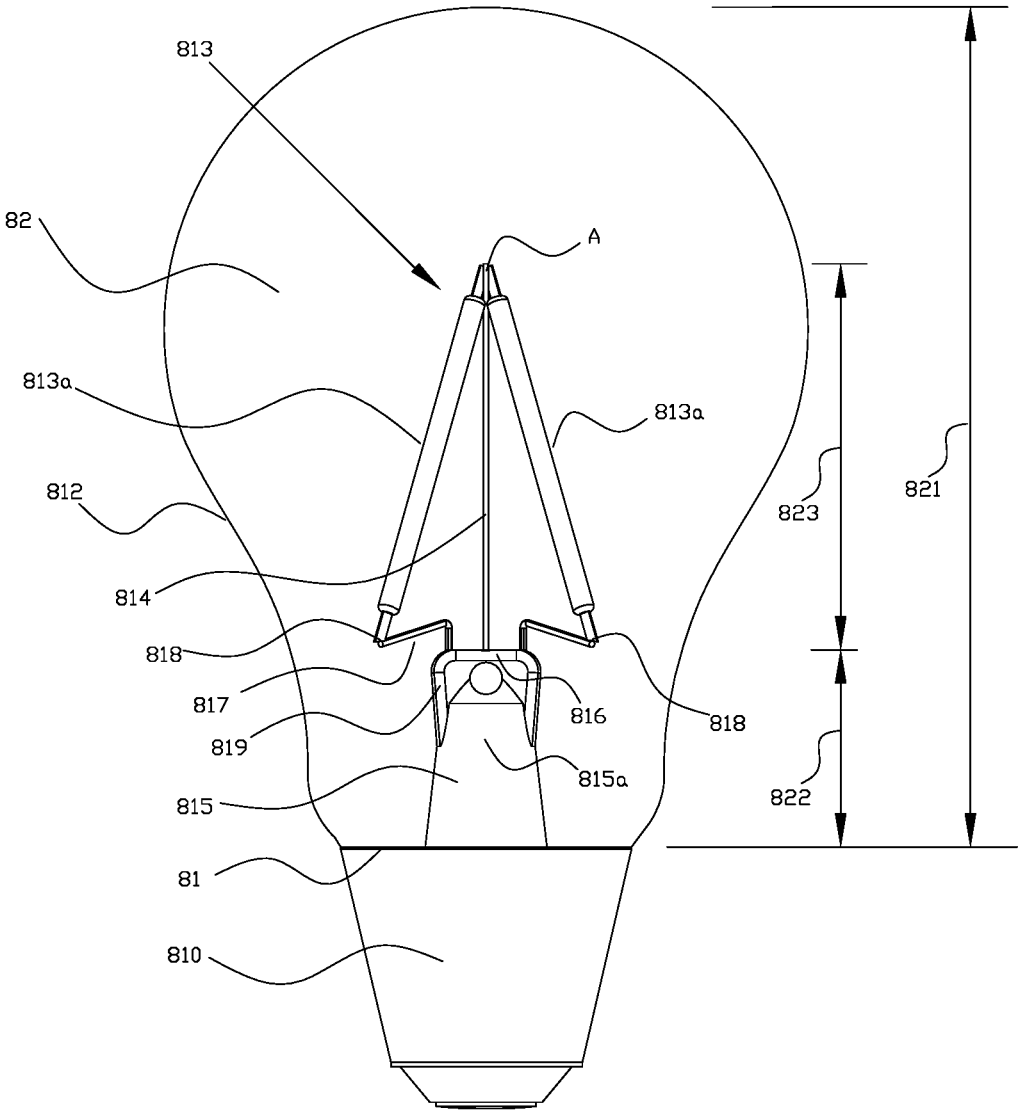
FIG. 8 is a schematic view illustrating the relative position of the elements.

Next, please refer to FIG. 8, where FIG. 8 illustrates the relative relationship between the inner elements for the above-described embodiments.

According to another embodiment of the present invention, there provides an illumination device. The lighting device has a light transmission housing (812), a base (810), a support base (815), a light bar module (813), and a metal support strip (814). As shown in figure, the metal support strip (814) referred to herein may be the support bar (20) described above (see FIG. 1 to FIG. 7). The light transmission housing (812) may be completed transmission, partially translucent or partially transmission. For example, the light transmission housing (812) may be made of a light-transmitting material such as glass or plastic material, and may be subjected to full or partial atomization or patterning on the surface.

The base (810) is connected to the light transmission housing (812) to form an accommodating space (82) together. For example, when the lighting device is a light bulb, the base (810) may be a conventional Edison light head, and the base (810) has two conductive terminals (not shown) on the side and the bottom for connecting to an external power source. Another embodiment is to provide a replaceable or rechargeable battery inside the base (810). If the external power supply is directly connected, the base (810) may be provided with a driving circuit for converting the general indoor power source into a voltage suitable for driving the light emitting diode.

A support base (815) is set on the base (810), and the bottom of the support base (815) extends generally horizontally and is extended to be connect to the bottom of the light transmission housing (812). The platform (816) at the uppermost the support base (815) and the support base (815) is set in the accommodating space (82), and the bottom of the platform (816) is connected to the support base (815). The base (810) and the light transmission housing (812) have a connection boundary line (81) from the outside of the illumination device. The top of the light transmission housing (812) is the first height (821) from the connection boundary line (81) to the top of the light transmission housing (812). The height of the top of the platform (816) to connect boundary line (81) is the second height (822).

In some embodiments, the light bar module (813) is formed by connecting at least two light bars (813*a*) in series. A support point A is between the at least two series of light bars (813*a*), and the light bar module (813) has two electrical connection points (818). Take the light bulb as an example, multiple light emitting diode chips may be packaged in series into a light bar (813*a*). Through the support point A, the light bar (813*a*) may be further connected in series or in parallel or in both of series and parallel. For the chips of the light-emitting diodes, there is a need for a positive voltage terminal and a negative voltage terminal and may be connected to the voltage supply point of the driving circuit to drive the Light Emitting Diode chip to emit light.

In some embodiments, at least two metal support strips (814) extend outwardly from the platform (816) of the support base (815), respectively, to the one support point A.

In some embodiments, the outward direction refers to multiple directions extending away from the support base (815) toward the light transmission housing (812). As shown in figure, the support strip (814) is made of a material of metal, and the metal material for making the metal support strip (814) is a pure metal or a metal alloy such as pure copper, pure aluminum, copper alloy, iron alloy, aluminum alloy, nickel alloy and so on. A vertical height of the metal support strip (814) extending outwardly from the top of the platform (816) is the third height (823) and is greater than the second height (822).

In addition, the at least two metal conductive strips (817) extend outwardly from the support base (815) and is connected to two electrical connection points (818) of the light bar module (813) respectively. Wherein the metal support strip (814), the light bar (813*a*) and the metal conductive strip (817) form two substantially triangular frame structures. The substantial triangular frame structure mentioned here does not need to be a geometric sense of the triangle. As long as the overall structure of a similar triangle may belong to the side of the real triangular box structure. In addition, the metal support strip (814), the light bar (813*a*) and the metal conductive strip (817) may be used for a part or all of the sides of the triangular frame structure, respectively, under different designs. In other embodiments, the substantial triangular frame structure is made of polygons having three long sides forming a substantially triangular shape. The present invention is not limited to these examples, and may be considered to be within the scope of the present invention as long as they may achieve a substantially similar effect.

In a design, the support base (815) also has a certain degree of transparency. For example, the support base (815) may be a material of glass. Also, the light transmission housing (812) may be a material of glass. When the support base (815) is the material of glass, the glass bulb may be blown by the production process of the conventional bulb to complete predetermined and a variety of shapes such as incandescent bulb type, water droplet type, candle bulb type, flat head type or multiple predetermined shapes, a pipe may be left in the blow molding process for filling the light transmission housing (812) with the heat dissipation gas. The actual method of operation includes placing the bulb housing (812) in a vacuum environment after the support base (815) is connected to the light transmission housing (812), and then pours various heat dissipation gases through the pipe. In addition, in some embodiments, when the power of the Light Emitting Diodes is small, the heat dissipation gas may not be completely filled and the air for example may be maintained at 3% or more. This may produce a certain degree of adjustment for the effect of light, and may reduce the manufacturing process requirements and cost.

In some embodiments, the top surface of the platform (816) of the support base (815) may be substantially planar and has no raised structure. This does not mean to keep a certain flat, but in essence there is no obvious convex structure. The support of the light bar (813*a*) is mainly achieved by the metal support strip (814).

In some embodiments, the position of the platform (816) is below the position of the bottom of the light bar (813*a*). In other words, the light bar module (813) is all held on the platform (816).

In some embodiments, the support base (815) has a top structure (819) and a base (815*a*). The top structure (819) is joined together with the base (815*a*) by welding, the metal support strip (814) being in contact with the metal conductive strip (817) extends from the top structure (819). In one embodiment, the top structure (819) is an inverted U-shape, and the base of the base (815*a*) is substantially circular.

In addition, in some embodiments, in order to adjust the relative position of the light bar module (813) and the light transmission housing (812), the light emitting effect of the surface of the light transmission housing (812) is made more uniform, and the second height (822) is more than 30% of the first height (821), such an arrangement may further optimize the light-emitting effect of the light transmission housing (812).

In some embodiments, at the support point A, the metal support strip (814) connects and supports the light bar module (813) by a snap-in structure (not shown). For example, the metal support strip (814) or the light bar (813*a*) has a certain degree of bending, buckle, spring, hook, groove, and bump at the support point A may save the complicated engineering of welding, or even if the welding, further strengthen the structure of the stable type.

In some embodiments, the metal support strip (814) and the metal conductive strip (817) are made of the same material.

In some embodiments, the metal support strip (814) forms an assembly unit with the light bar module (813), forms a predetermined shape and is mounted to the light transmission housing (812) in the form of an assembly unit. In this way, the complexity of assembly may be reduced to a certain extent.

In addition, in some embodiments, the light bar (813*a*) may encapsulate the diode chip on both sides to achieve a higher luminous effect.

In some embodiments, the metal conductive strip (817) has a rigidity that maintains a fixed shape. In some embodiments, the metal support strip (814) has a groove along its length. For example, the metal support strip (814) is elongated and folded at a certain angle along a length to achieve greater rigidity with less material. In some embodiments, the metal support strip (814) is nickel plated.

Figure 9:
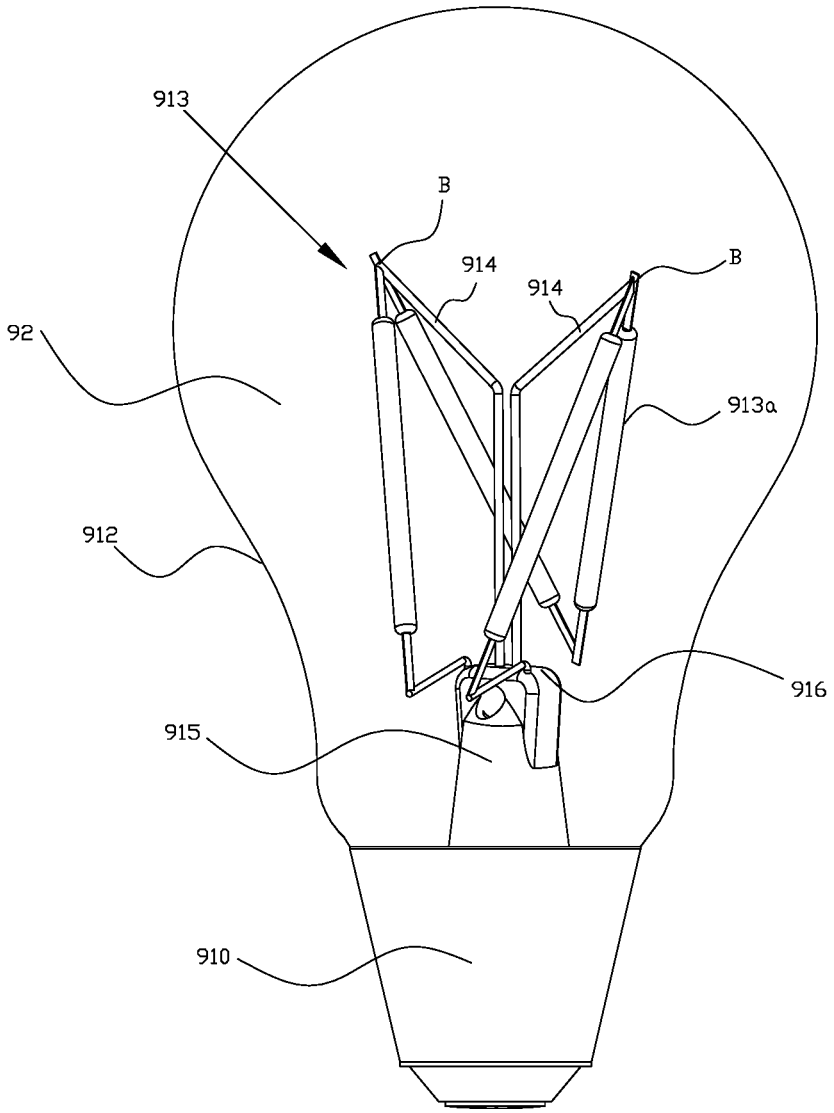
FIG. 9 is a schematic view of a lighting device according to another embodiment of the present invention.

Please refer to FIG. 9. According to another embodiment of the present invention, there provides an illumination device including a light transmission housing (912), a light bar module (913) connected in series by at least two light bars (913*a*). The light bars (913*a*) is set with multiple light emitting diode chips having two support points B between at least two series of light bars (913*a*), a transparent support base (915) having a platform (916) substantially without raised structure, and the transparent support base (915). The bottom of the base extends generally horizontal and is extended to be connected to the bottom of the light transmission housing (912), which forms an accommodating space (92) with the light transmission housing (912), and at least two support strips (914). The transparent support base (915) extends upwardly to connect the support point B, respectively, and a base (910) which is set at the lower end of the light transmission housing (912). The base (910) is connected to the light transmission housing (912), and the base (910) is electrically connected to an external power source (not shown). In some embodiments, wherein the support strip (914) is preferably a metallic material and remains substantially linearly extending. The metal materials used to make the support strips (914) include pure metals and alloys such as pure copper, pure aluminum, copper alloys, ferroalloys, aluminum alloys, nickel alloys, and the like.

Figure 10:
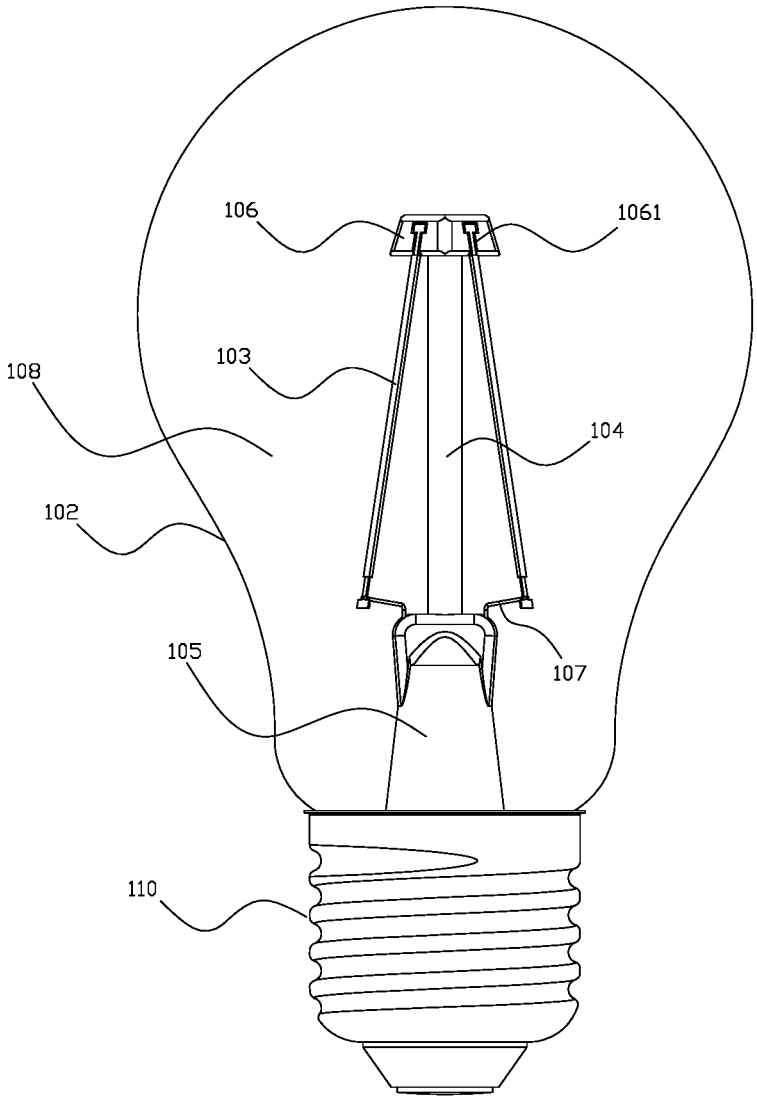
FIG. 10 is a schematic view of a lighting device according to another embodiment of the present invention.

Please refer to FIG. 10. According to another embodiment of the present invention, there is provided an illumination device including a bulb shell (102), a light head (110), a support base (105), a support body (104), at least two strip light bars (103), and at least two of the metal conductive strip (107). The bottom of the bulb shell (102) is connected to the bottom of the support base (105) to form an accommodation space (108), and the bulb shell (102) is connected to the support base (105), and the bottom of the bulb shell (102) is fixedly connected to the light head (110). The support body (104) is provided in the accommodating space (108), and one end of the support body (104) is fixed to the top of the support base (105). The top of the support body (104) is provided with a magnetic terminal (106). One end of the metal conductive strip (107) protrudes from the top of the support base (105), and the other end of the metal conductive strip (107) is electrically connected to the drive plate (not shown) provided in the light head (110) through the bottom of the support base (105). The Each of the strip light bars (103) has at least two LED light emitting chips (not shown), one end of which is electrically connected to one end of the metal conductive strip (107), the strip light bars (103) is electrically connected to the magnetic terminal (106). The magnetic terminal (106) at the other end of the support body (104) connects the other end of the at least two strip light bars (103) so that the LED light-emitting chips on the at least two strip light bars (103) emit light toward a predetermined angle. Wherein the other end of the support body (104) is connected to the other end of the at least two strip light bars (103) by magnetic attraction. In other words, the support body (104) may be a metallic material, a glass material or other material. Of course, the support body (104) may be of a different shape as long as the strip light bar (103) may be lighted at a predetermined angle.

The magnetic force described above may come from the magnetic terminal (106) at the top of the support body (104), or may from the end of the strip light bar (103), or from the support body (104) and the strip light bar (103) itself.

The support body (104) and the at least two strip light bars (103) may be electrically connected. In other words, although the support body (104) and the strip light bar (103) have the effect of being supported, they may not have the effect of electrical connection, and the current does not pass directly through the support.

Please refer to FIG. 10, in a preferred embodiment, the magnetic terminal (106) includes a magnet having a conductive material on the surface of the magnetic terminal (106), which may be a conductive layer sprayed on the surface of the magnetic terminal (106). A metal member expose to the surface of the magnetic terminal (106), one end of the strip light bar (103) is electrically connected to the metal conductive strip 107, and the other end of the strip light bar (103) is electrically connected to the surface of the magnetic terminal (106) by magnetic attraction so that the strip light bars (103) are electrically connected in series or parallel or in series and parallel through the magnetic terminals (106). Further, a fixing groove (1061) for reinforcing the stability of the strip light bar (103) and the magnetic terminal (106) may be set in the surface of the magnetic terminal (106), and the shape of the fixing groove (1061) is preferably. chosen to be T-shaped. The other end of the strip light bars (103) is also set in a shape corresponding to the shape of the fixing groove (1061) and attract to the fixing groove (1061) so that the other end of the strip light bars (103) and the magnetic terminal (106) may be more stable to meet a certain shock and drop the impact.

In other embodiments, the top of the support body (104) may also form an electrical connection structure for electrically connecting the two strip lights bars (103) to each other. For example, a conductive snap, slot, and so on to make the structure be added to the top of the support so that the two strip lights bars (103) are indirectly connected to the support body (104) and indirectly make the electronic connection between the strip lights bars (103).

In addition, in other embodiments, the support body (104) may provide power to the strip light bar (103) by a location connected to the strip of light strip bar (103). The strip bar (103) may be connected in parallel or in series or in both series and parallel connection via magnetic terminals (106).

It is intended that the present invention be limited to the preferred embodiments of the present invention and is not to be construed as limiting the invention. Any modifications, equivalents, improvements, and the like within the spirit and principles of the invention are intended to be included within the scope of the present invention.

The invention claimed is:

1. An LED filament light apparatus comprising:

a bulb head;

a stem fixed to the bulb head;

a support bar made of a rigid material, the support bar being fixed to the stem;

at least two electrode wires; and at least two LED filament strips, wherein each LED filament strip comprises a base, an LED chip is set on the base and electrodes are fixed at both ends of the base, wherein one end of the electrode is electrically connected with the LED chip on the base, the other end of the electrode is electrically connected with the electrode of another LED filament or electrically connected to one end of the electrode wires, and wherein there are at least two LED filament strips directly fixed to bent ends of the support bar for expanding luminance angles of the LED filament strips, and the bent ends of the support bar having the same material as other portion of the support bar.

2. The LED filament light apparatus of claim 1, wherein the bulb further comprises a bulb shell, the bulb shell and the stem form a confined space, the electrode wires extend from the outside into the confined space, and the LED filament strip is accommodated in the confined space.

3. The LED filament light apparatus of claim 2, wherein the confined space is filled with heat dissipation gas.

4. The LED filament light apparatus of claim 1, wherein the support bar is made of metal material, and the other end of the support bar is fixedly connected to the LED filament strip.

5. The LED filament light apparatus of claim 1, wherein the other end of the electrode is fixed by welding to the electrode of the other LED filament strip to achieve electrical connection.

6. The LED filament light apparatus of claim 1, wherein the electrode wire is made of a wire, and the wire is bendable and has a structural strength.

7. The LED filament light apparatus of claim 1, further comprising a drive assembly, and an insulating sleeve, the drive assembly being housed in the insulating sleeve, wherein the insulating sleeve is housed in the bulb head.

* * * * *